US009407983B2

(12) United States Patent
Kumagai et al.

(10) Patent No.: US 9,407,983 B2
(45) Date of Patent: Aug. 2, 2016

(54) MICROPHONE DEVICE

(71) Applicant: Yamaha Corporation, Hamamatsu-shi, Shizuoka (JP)

(72) Inventors: Kunihiro Kumagai, Hamamatsu (JP); Yasuo Shiozawa, Heverlee (BE); Shuichi Esaki, Hamamatsu (JP); Hirofumi Onitsuka, Hamamatsu (JP); Kiyohiko Goto, Iwata (JP); Yoshiaki Tsutsui, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/379,938

(22) PCT Filed: Feb. 14, 2013

(86) PCT No.: PCT/JP2013/053499

§ 371 (c)(1),
(2) Date: Aug. 20, 2014

(87) PCT Pub. No.: WO2013/125434

PCT Pub. Date: Aug. 29, 2013

(65) Prior Publication Data

US 2015/0373438 A1 Dec. 24, 2015

(30) Foreign Application Priority Data

Feb. 21, 2012 (JP) ..... 2012-034892
Dec. 10, 2012 (JP) ..... 2012-269546

(51) Int. Cl.
*H04R 1/22* (2006.01)
*H04R 1/02* (2006.01)
(Continued)

(52) U.S. Cl.
CPC ..... *H04R 1/222* (2013.01); *H04R 1/021* (2013.01); *H04R 1/083* (2013.01); *H04R 29/004* (2013.01)

(58) Field of Classification Search
CPC ..... H04R 1/08; H04R 1/083; H04R 1/326; H04R 1/342; H04R 1/46; H04R 29/001; H04R 29/004; H04R 1/021; H04R 1/222; G10K 11/002; H04S 7/30
See application file for complete search history.

(56) References Cited

U.S. PATENT DOCUMENTS 4,522,283 A * 6/1985 Smith ..... G10K 11/002 181/175
4,570,742 A 2/1986 Takise
(Continued)

FOREIGN PATENT DOCUMENTS

CN 102106158 A 6/2011
JP 2-098592 U 8/1990
(Continued)

OTHER PUBLICATIONS

Chinese Office Action dated May 7, 2015 with English-language translation (eleven (11) pages).
(Continued)

*Primary Examiner* — Curtis Kuntz
*Assistant Examiner* — Joshua Kaufman
(74) *Attorney, Agent, or Firm* — Crowell & Moring LLP

(57) ABSTRACT

A microphone device includes: a housing having an opening section in an upper face thereof; and a non-directional microphone unit incorporated in the housing and provided inside the opening section. The upper face of the housing has a shape in which a distance from an edge defined as a boundary between the upper face and a side face or a bottom face to the opening section throughout a whole circumference of the upper face changes in ½ or more of the whole circumference of the edge and an average value of the distance from the edge to the opening section is shorter than ½ of a wavelength of a sound wave in a frequency range in which an auditory sensitivity of humans is low.

2 Claims, 8 Drawing Sheets

(51) Int. Cl.
*H04R 1/08* (2006.01)
*H04R 29/00* (2006.01)

(56) References Cited

U.S. PATENT DOCUMENTS 5,121,426 A * 6/1992 Baumhauer, Jr. ..... H04M 1/20 379/388.02
5,168,525 A 12/1992 Müller
5,854,848 A * 12/1998 Tate ..... H04R 1/04 379/433.03
6,009,184 A * 12/1999 Tate ..... H04R 1/04 379/433.03
6,111,962 A * 8/2000 Akio ..... G10H 1/0091 381/104
6,285,772 B1 * 9/2001 Tate ..... H04R 1/406 379/433.03
6,396,932 B1 * 5/2002 Tate ..... H04M 1/19 381/357
7,339,605 B2 * 3/2008 Rodman ..... H04B 1/40 348/14.04
8,045,741 B2 * 10/2011 Yoshino ..... H04S 11/04 381/177
8,442,256 B2 * 5/2013 Yoshino ..... H04R 1/08 381/122
8,644,525 B2 * 2/2014 Bathurst ..... H04M 3/56 379/202.01
2005/0259842 A1 * 11/2005 Akino ..... H04R 1/08 381/369
2006/0078149 A1 * 4/2006 Akino ..... H04R 1/086 381/369
2006/0104470 A1 * 5/2006 Akino ..... H04R 1/04 381/369
2007/0147634 A1 * 6/2007 Chu ..... H04R 3/005 381/92
2008/0159578 A1 * 7/2008 Akino ..... H04R 1/04 381/361
2008/0232629 A1 * 9/2008 Akino ..... H04R 1/086 381/355
2009/0097686 A1 * 4/2009 Yoshino ..... H04R 11/04 381/355
2009/0285055 A1 * 11/2009 Barger ..... B64C 27/04 367/188
2009/0301205 A1 * 12/2009 Reiche ..... G10K 9/122 73/632
2010/0246876 A1 * 9/2010 Akino ..... H04R 1/02 381/361
2010/0260347 A1 * 10/2010 Baggs ..... H04R 3/007 381/71.2
2010/0303272 A1 * 12/2010 Yoshino ..... H04R 1/08 381/357
2010/0322450 A1 * 12/2010 Akino ..... H04R 1/086 381/355
2011/0019856 A1 * 1/2011 Matsui ..... H04R 1/406 381/355
2011/0025916 A1 * 2/2011 Kohara ..... H04S 7/30 348/563
2011/0170727 A1 * 7/2011 Akino ..... H04R 3/005 381/361
2011/0182456 A1 * 7/2011 Akino ..... H04R 1/083 381/361
2011/0228966 A1 * 9/2011 Varla ..... H04R 1/24 381/386
2012/0099752 A1 * 4/2012 Akino ..... H04R 1/086 381/361
2014/0148224 A1 * 5/2014 Truong ..... H04M 9/085 455/557
2014/0211974 A1 * 7/2014 Pielsticker ..... H04R 1/086 381/359
2015/0215689 A1 * 7/2015 Hartung ..... H04M 3/567 381/356

FOREIGN PATENT DOCUMENTS

JP 3-88599 A 4/1991
JP 2009-37143 A 2/2009
JP 2010-278988 A 12/2010

OTHER PUBLICATIONS

English translation of document C2 (Japanese-language Written Opinion (PCT/ISA/237) dated Mar. 12, 2013) previously filed on Aug. 20, 2014 (Four (4) pages).
International Search Report dated Mar. 12, 2013, including English translation (Three (3) pages).
Japanese-language Written Opinion (PCT/ISA/237) dated Mar. 12, 2013 (Three (3) pages).
Notification of Reason for Refusal dated Aug. 22, 2014 w/ partial English translation (Seven (7) pages).
European Search Report issued in counterpart European Application No. 13752212.4 dated Sep. 29, 2015, (nine (9) pages).
Bernhard Mueller, "Ein neuer Typ von Grenzflaechenmikrofon", Radio Fernsehen Elektronik, vol. 40, No. 1, 1991, XP000224283, pp. 10-13.
Frank Steffen, "Eigenschaften and Aufgaben von Grenzflaechenmikrofonen", Radio Fernsehen Elektronik, vol. 40, No. 1, 1991, XP000224282, pp. 8-9.

* cited by examiner

Prior Art

Prior Art

Prior Art

MICROPHONE DEVICE

TECHNICAL FIELD

The present invention relates to a microphone device configured to reduce fluctuations in frequency characteristics due to diffracted sound and reflected sound.

BACKGROUND ART

A technique in which the acoustic characteristics of a speaker or a listening room are measured using a microphone and an audio signal is equalized on the basis of the results of the measurement has been put into practical use, and a technique for enhancing the accuracy of the measurement using the microphone has also been proposed (for example, refer to Patent Document 1). FIG. 1 is an external view showing a microphone device 100 having been used conventionally for this measurement. This microphone device 100 has a housing being composed of a disc-shaped base section 101 and a neck 102 provided upright at the center of this base section 101. At the top of the neck 102, an opening section 102A is provided, and inside the neck 102, a microphone unit 103 is incorporated toward the opening section 102A. In the above-mentioned measurement, the microphone device 100 is placed at a listening point, test sound is emitted from the speaker, and the test sound picked up by the microphone device 100 is analyzed to determine the acoustic characteristics of the speaker and the listening room.

Furthermore, as shown in FIG. 2, a technique wherein a microphone base 110 having three concave sections 111 is placed at a listening point, the microphone device 100 is mounted sequentially in the three concave sections 111, and test sound is picked up sequentially to measure the acoustic characteristics of the listening room three-dimensionally has also been put into practical use.

PRIOR ART DOCUMENT

Patent Document

Patent Document 1: JP-A-2009-37143

SUMMARY OF THE INVENTION

Problem that the Invention is to Solve

The frequency characteristics of the microphone device for use in the above-mentioned measurement are desired to be flat. However, in the conventional microphone device 100 shown in FIG. 1, diffracted-reflected sound due to the edge of the base section 101 of the housing and reflected sound reflected by the microphone base 110 in the case that the microphone device 100 is placed on the microphone base 110 are picked up together with direct sound as shown in FIG. 3, and the frequency characteristics do not become flat because of interference due to the distance differences between the direct sound and the diffracted-reflected sound and between the direct sound and the reflected sound, thereby causing a problem that errors occur in the results of the measurement. The diffracted-reflected sound is herein the sound obtained in the case that the reflected sound from the surface of the microphone device 100 is diffracted (diffraction) and picked up by the microphone unit 103, and the sound is hereafter referred to as "diffracted-reflected sound (due to the edge)" because the contribution of the diffraction from the edge is dominant to the fluctuations in the characteristics due to interference.

The present invention is intended to provide a microphone configured to suppress fluctuations in frequency characteristics due to diffraction and reflection as much as possible.

Means for Solving the Problem

The present invention is a microphone device comprising: a housing having an opening section in an upper face thereof; and a non-directional microphone unit incorporated in the housing and provided inside the opening section, wherein the upper face of the housing has a shape in which a distance from an edge defined as a boundary between the upper face and a side face or a bottom face to the opening section throughout a whole circumference of the upper face changes in ½ or more of the whole circumference of the edge and an average value of the distance from the edge to the opening section is shorter than ½ of the wavelength of a sound wave in a frequency range in which an auditory sensitivity of humans is low.

The frequency range in which the auditory sensitivity of humans is low may be 10 kHz. In addition, a ratio of a longest distance to a shortest distance, from the edge to the opening section, may be two or more. Furthermore, the opening section may be provided at a center of a circumscribed circle of a planar shape of the upper face. Moreover, a planar shape of the upper face may be a triangle.

Advantage of the Invention

With the present invention, the influence of diffracted sound and reflected sound on the frequency characteristics of the sound picked up by the microphone unit can be suppressed to the minimum.

MODE FOR CARRYING OUT THE INVENTION

Figure 4:
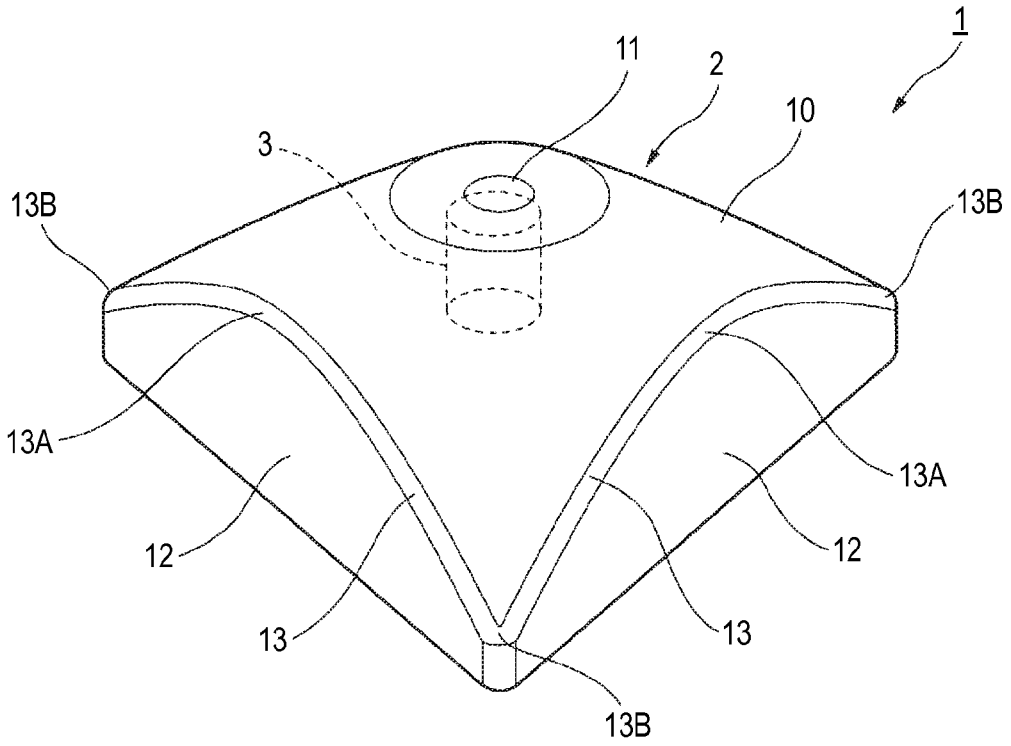
FIG. 4 is an external view showing a microphone device according to an embodiment of the present invention.

FIG. 4 is an external view showing a microphone device 1 according to an embodiment of the present invention. This microphone device 1 is used as a measurement microphone for measuring the acoustic characteristics of an audio system and a listening room. The microphone device 1 has a housing 2 and a microphone unit 3 incorporated in the housing 2. The planar shape of the housing 2 (the microphone device 1) is a nearly equilateral triangle, and its overall shape is such a shape as obtained by vertically cutting off a gently sloping cone so that the shape matches the planar shape of the above-mentioned nearly equilateral triangle. The upper face 10 of the housing 2 has an opening section 11 at the center and is inclined downward toward sides 13 serving as peripheral edges (edges) with the opening section 11 as an apex. With this configuration, the upper face 10 on the side 13 is a curved face being highest at an intermediate point 13A nearest from the opening section 11 and lowest at apexes 13B farthest from the opening section 11. Hence, the side face 12 formed vertically downward from the side 13 of the upper face 10 is an arch-shaped plane being highest at the center portion, that is, the intermediate point 13A, and lowest at both ends, that is, the apexes 13B.

In addition, inside the opening section 11, the non-directional microphone unit 3 is provided upward.

With this shape, the distance of the side (edge) of the upper face 10 from the opening section 11 (the microphone unit 3) is not constant. In other words, in the range from the intermediate point 13A being nearest to the opening section 11 to the apex 13B being farthest from the opening section 11, the distance (to the opening section 11) changes gradually, and the ratio between the distance to the nearest point (the intermediate point 13A) and the distance to the farthest points (the apex 13B) is approximately 1:2.5.

Furthermore, as the planar dimensions of the microphone device 1, the dimension from the center portion of the opening section 11 to the apex 13B is approximately 2 cm, the dimension from the center portion of the opening section 11 to the intermediate point 13A is approximately 1 cm, and the height of the microphone device 1 is approximately 1.5 cm. When it is assumed that the speed of sound is 340 m/s, 1 cm corresponds to ½ of the wavelength λ of a 17 kHz sound wave.

With this shape, frequency characteristics are improved because of the following reasons.

(1) Since the distance from each point of the side 13 of the upper face 10 to the opening section 11 (the microphone unit 3) changes gradually, the path length of the diffracted-reflected sound entering the microphone unit 3 from each point of the side (edge) 13 is different, whereby the influence on the direct sound entering the microphone unit 3 due to the interference is not concentrated on a specific frequency.

(2) Since the dimensions of the housing are short as described above, the path difference between the direct sound and the diffracted-reflected sound at the side 13 is small, and since the influence on the direct sound due to the diffracted-reflected sound appears in a high-frequency band (for example, an inaudible band), the influence on acoustic feeling is small.

Generally speaking, it is assumed that the audible range of humans is 20 Hz to 20 kHz. Within the range, the sensitivity of human ears is high for the sound in a frequency range of 2 kHz to 4 kHz, and the sound in this range is easy to hear. However, in frequencies higher than this range, the sensitivity lowers depending on the level of a signal, and humans gradually become unaware of sound; for example, it is difficult to hear the sound in a frequency range around 10 kHz and humans become unaware of the sound. For example, even if there is the influence of the diffracted-reflected sound, in the case that the frequency is, for example, approximately 10 kHz or more, it is assumed that the influence on acoustic feeling is negligible in practice.

Figure 1:
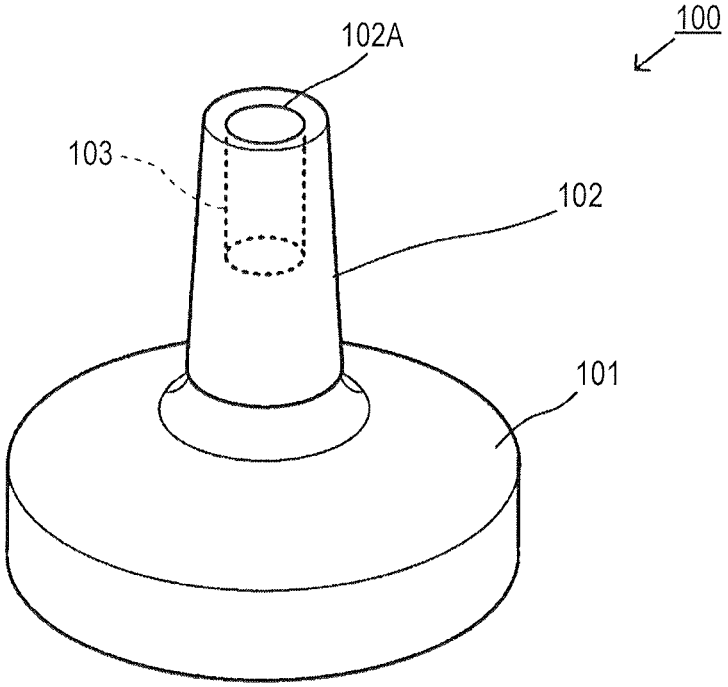
FIG. 1 is an external view showing a conventional microphone device.
Figure 3:
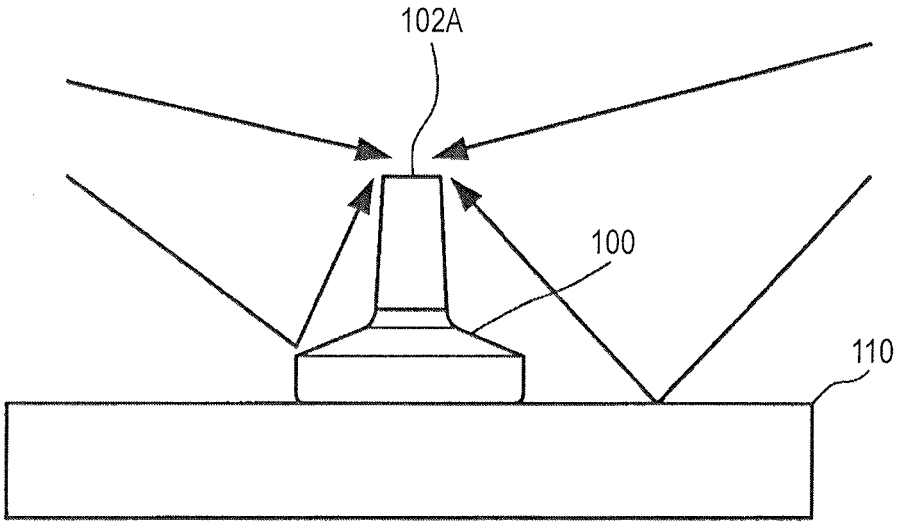
FIG. 3 is a view illustrating diffracted sound and reflected sound entering the conventional microphone device.
Figure 5A:
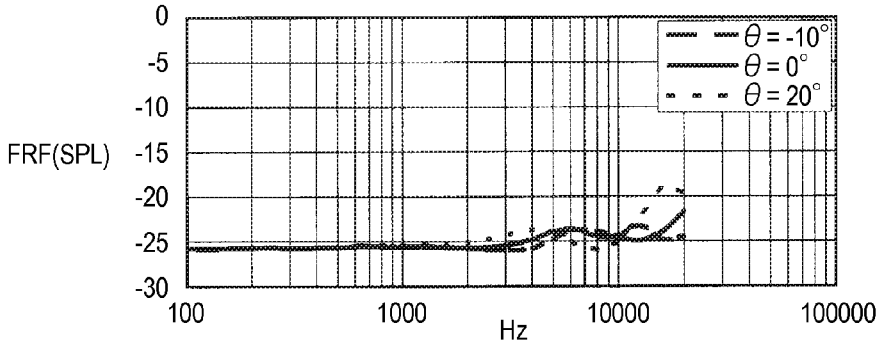
FIGS. 5A to 5D are graphs showing the frequency characteristics of the microphone device according to the above-mentioned embodiment and the frequency characteristics according to comparison examples.
Figure 5B:
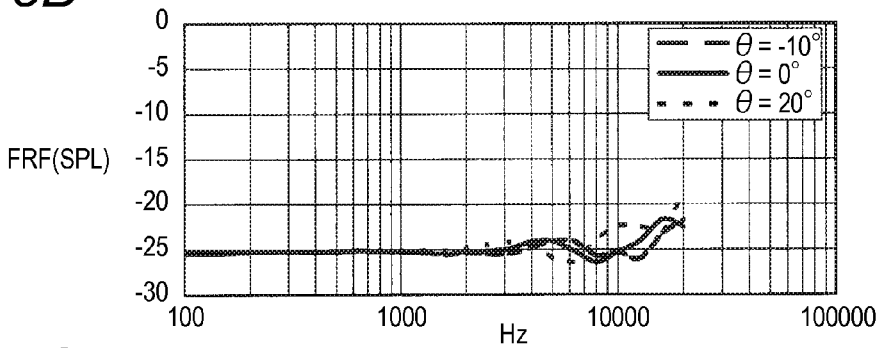
Figure 5C:
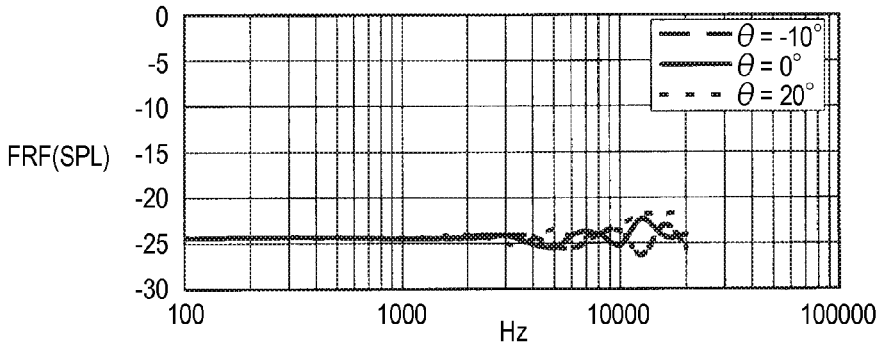
Figure 5D:
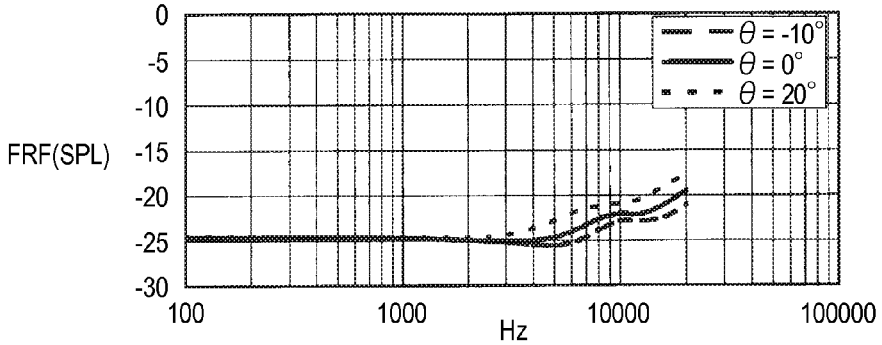
Figure 6A:
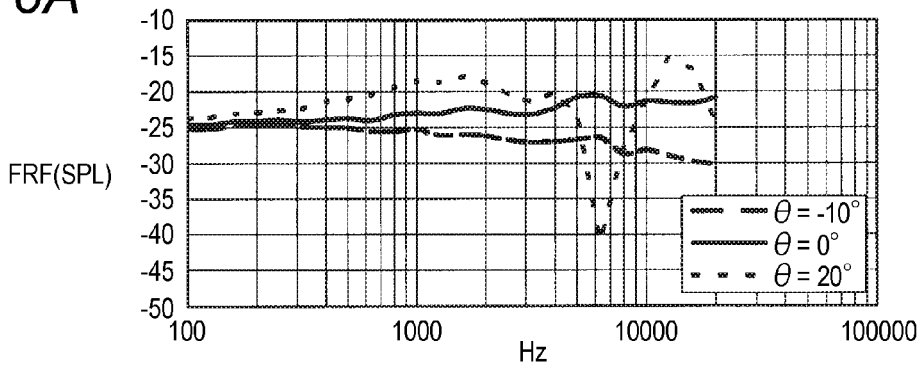
FIGS. 6A to 6D are graphs showing the frequency characteristics of the microphone device according to the above-mentioned embodiment and the frequency characteristics according to comparison examples.
Figure 6B:
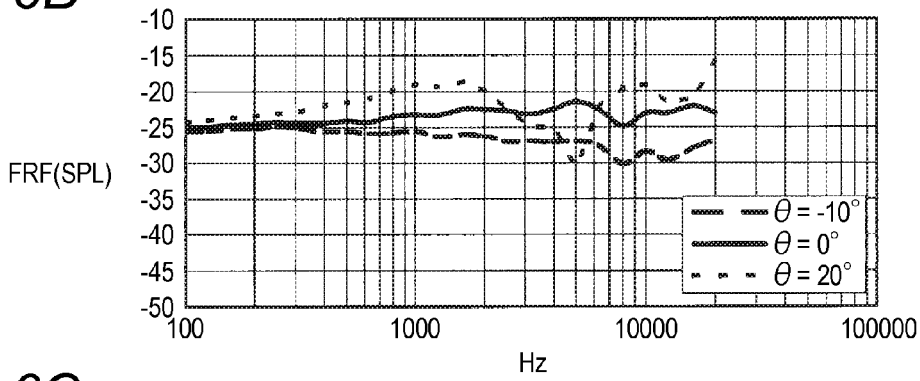
Figure 6C:
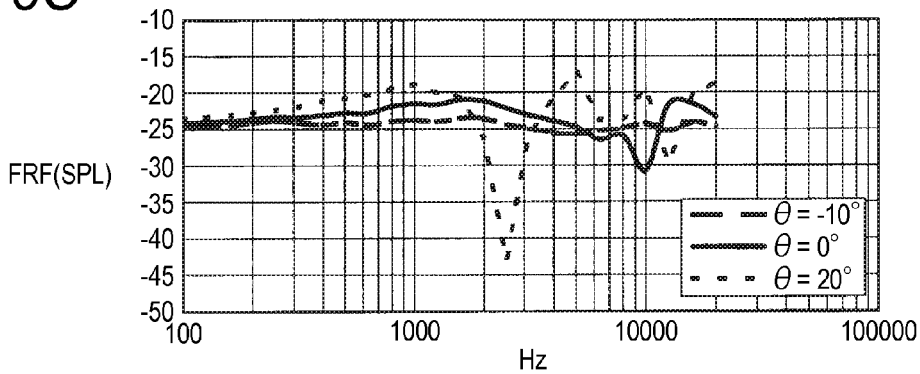
Figure 6D:
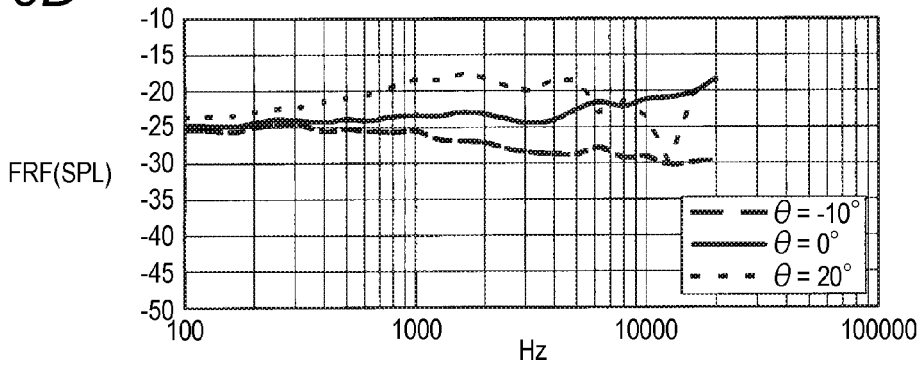

FIG. 5D and FIG. 6D are graphs showing the frequency characteristics of the microphone device 1 shown in FIG. 4. FIGS. 5A to 5D are graphs showing the frequency characteristics in the case that the microphone device 1 is placed in the air, and FIGS. 6A to 6D are graphs showing the frequency characteristics in the case that the microphone device 1 is mounted on a base (for example, such a base as shown in FIG. 3). Both show the frequency characteristics of sounds arriving from a horizontal direction (θ=0°), a 20 degrees upward direction (θ=20°) and a 10 degrees downward direction (θ=−10°). These figures also show, as comparison examples, the characteristics (FIGS. 5A and 6A) of the microphone device having the conventional shape shown in FIG. 1, the characteristics (FIGS. 5B and 6B) of a microphone device having a shape with a neck longer than that of the conventional shape shown in FIG. 1, and the characteristics (FIGS. 5C and 6C) of a microphone device having a shape with a pedestal having a quadrangular planar shape and with a longer neck.

As described above, since FIGS. 5A to 5D show the frequency characteristics in the case that the microphone device 1 is placed in the air, it is assumed that only the diffracted-reflected sound due to the housing 2, more particularly, the side (edge) 13, affects the frequency characteristics of the sound signal picked up by the microphone unit 3.

In both the comparison examples shown in FIGS. 5A and 5B, the characteristics of sounds arriving from any directions are changed at 2 kHz or more, and the changes in the characteristics are not the same depending on the arrival angle. Furthermore, in the sound arriving from the 20 degrees upward direction, a dip (minimum value) occurs in an audible range of 10 kHz or less. Moreover, in the comparison example shown in FIG. 5C, although small changes occur in the characteristics at 2 kHz or more, the characteristics are flat as a whole. However, since the changes in the characteristics vary depending on the arrival angle, it is difficult to make correction. On the other hand, in the microphone device 1 shown in FIG. 5D according to the embodiment of the present application, the characteristics of the sounds arriving from any angles do not fluctuate up and down extremely, and the characteristics of the sounds arriving from any angles are similar to one another, that is, slightly rise at approximately 3 kHz or more; hence, correction can be made in post-stage circuits, and accurate measurement can be made.

Next, since FIGS. 6A to 6D show the frequency characteristics in the case that the microphone device 1 is mounted on the base as described above, it is assumed that the diffracted-reflected sound due to the sides (edges) 13 of the housing 2 and the reflected sound reflected by the surface of the base affect the frequency characteristics.

In all the examples shown in FIGS. 6A to 6D, as the frequency becomes high, the gain (characteristic) of the sound arriving from the 20 degrees upward direction rises due to the influence of the reflection by the base, and as the frequency becomes high, the gain of the sound arriving from the 10 degrees downward direction lowers due to the influence of the shielding by the base. Furthermore, in the case of the sound arriving from the 20 degrees upward direction, since the reflected sound reflected by the base is picked up by the microphone unit 3, a dip (minimum value: path difference ½λ) and a peak (maximum value: path difference λ) occur in the frequency characteristics depending on the path difference between the direct sound and the reflected sound. As the distance between the face of the base and the microphone unit is longer, that is, as the neck is longer, the path difference becomes larger, and the frequencies at the peak and the dip are shifted to lower frequency bands. In the comparison example in FIG. 6A, a dip occurs at around 6500 Hz, in the comparison example in FIG. 6B, a dip occurs at around 5000 Hz, and in the comparison example in FIG. 6C, a dip occurs at a lower frequency, that is, around 2500 Hz. On the other hand, in the microphone device 1 according to the embodiment of the present application shown in FIG. 6D, a dip occurs at a frequency higher than 10000 Hz in which the influence on acoustic feeling is small, whereby the influence of the dip on the adjustment of hi-fi audio is small. As described above, in the case of the shape of the microphone device 1 shown in FIG. 4, the frequency characteristics are less susceptible to the influence of the diffracted-reflected sound due to the sides (edges) 13 of the housing 2 and the reflected sound due to the face of the base than the frequency characteristics in the other comparison examples; even if the frequency characteristics are affected, correction can be made easily.

Figure 7A:
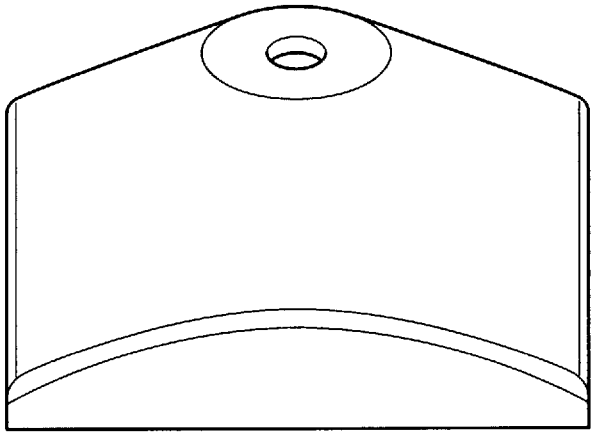
FIGS. 7A to 7C are views showing modification examples of microphone devices to which the present invention is applied.
Figure 7B:
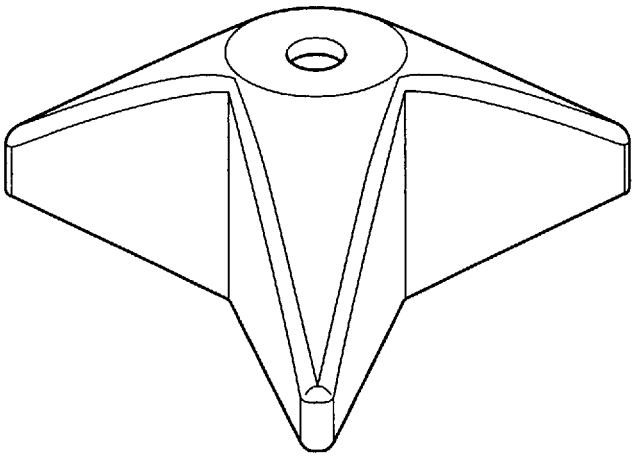
Figure 7C:
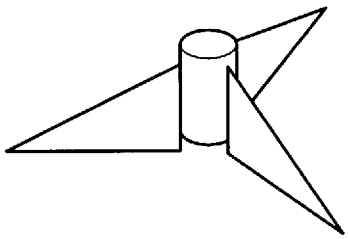
Figure 8A:
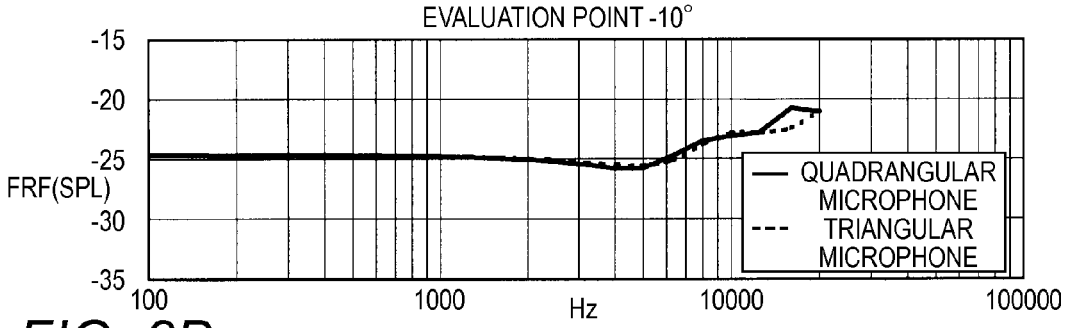
FIGS. 8A to 8D are graphs in which the frequency characteristics of the microphone device shown in FIG. 4 are compared with the frequency characteristics of the microphone devices shown in FIG. 7A.
Figure 8B:
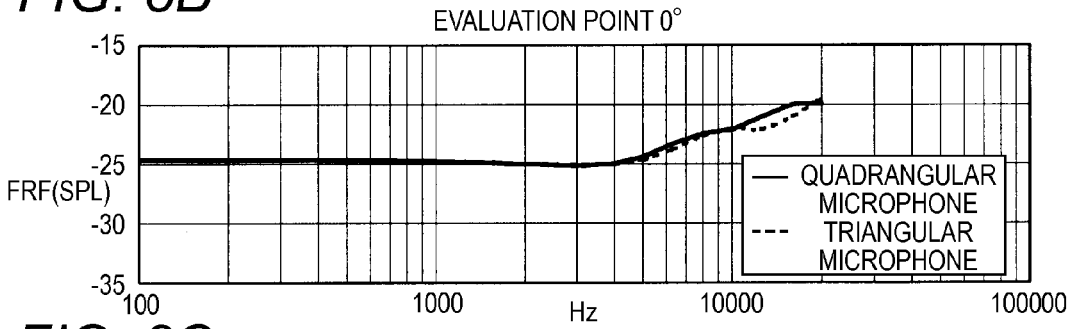
Figure 8C:
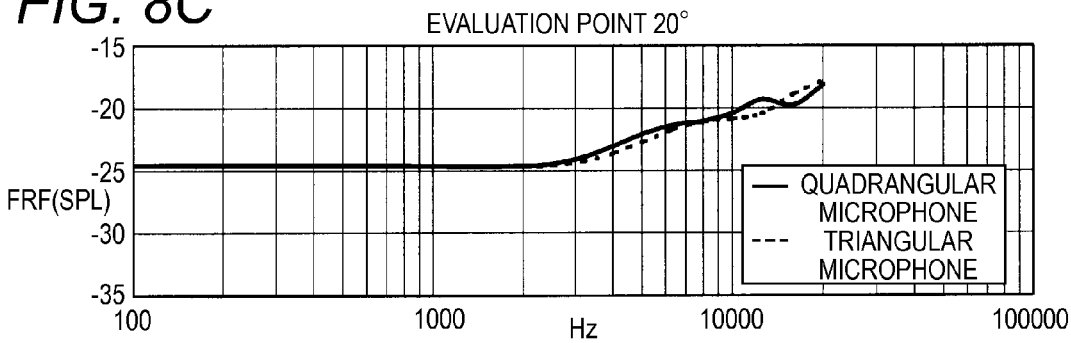
Figure 8D:
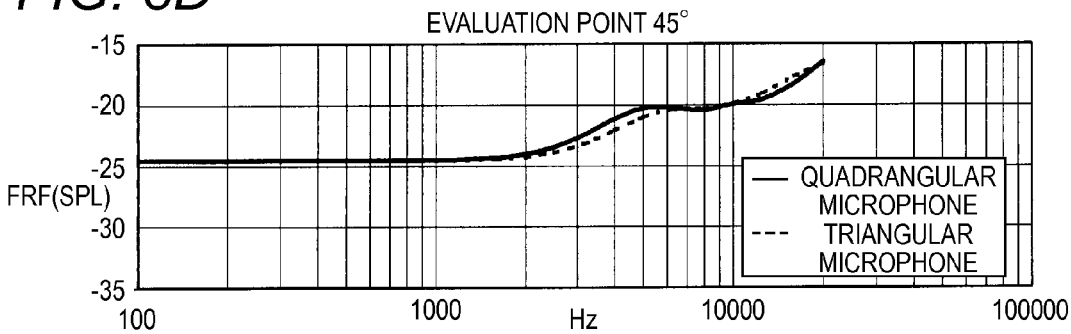

Furthermore, the shape of the microphone device 1 according to the present invention is not limited to that shown in FIG. 4. The shape may merely be such that the distance from the side 13 of the upper face 10 of the housing to the opening section 11 is not constant or such that the dimensions of the housing are short (the path difference between the diffracted-reflected sound and the direct sound is smaller than ½λ of an audible frequency), and various shapes, such as those shown in FIGS. 7A to 7C, can be conceived. The planar shape of the housing shown in FIG. 7A is a quadrangle (square). The housing having this shape is easy to produce and stable when mounted on the base. The planar shape of the housing shown in FIG. 7B is a polygon with re-entrant angles (starfish shape). In the housing having this shape, since the distance difference between the nearest point and the farthest point thereof is large, the influence of the diffracted-reflected sound due to the edges can be reduced further. Moreover, the housing shown in FIG. 7C is made small to the extent that it can accommodate the microphone unit, and is provided with three legs so as to be fitted in the concave sections 111 of the microphone base 110 shown in FIG. 2. With this shape, the influence of the diffracted-reflected sound due to the housing is almost negligible.

As described above, the microphone device 1 is desired to satisfy the following conditions. The shape of the upper face is desired to have lengthily protruding portions and deeply recessed portions, that is, the distance difference (distance ratio) between the nearest point and the farthest point is larger the better, so that the distance between the side (edge) of the upper face of the housing and the microphone unit does not become constant throughout the whole circumference. However, the overall size is smaller the better, and in the case that the distance to the farthest point is smaller than ½λ of an audible frequency, the band where interference occurs is in an inaudible region, whereby it is not necessary to consider the shape. In the case that the distance from the side 13 of the upper face of the housing to the opening section 11 changes as in the present invention, it has been confirmed from experiments that there is no problem in acoustic feeling, provided that the average value of the distances is approximately ½ of the wavelength in the frequency of approximately 10 kHz. As the microphone device is smaller, the characteristics becomes better as described above; however, the microphone device is required to have a certain amount of weight because the microphone cable thereof is drawn therefrom; otherwise, the microphone device is unstable.

Figure 2:
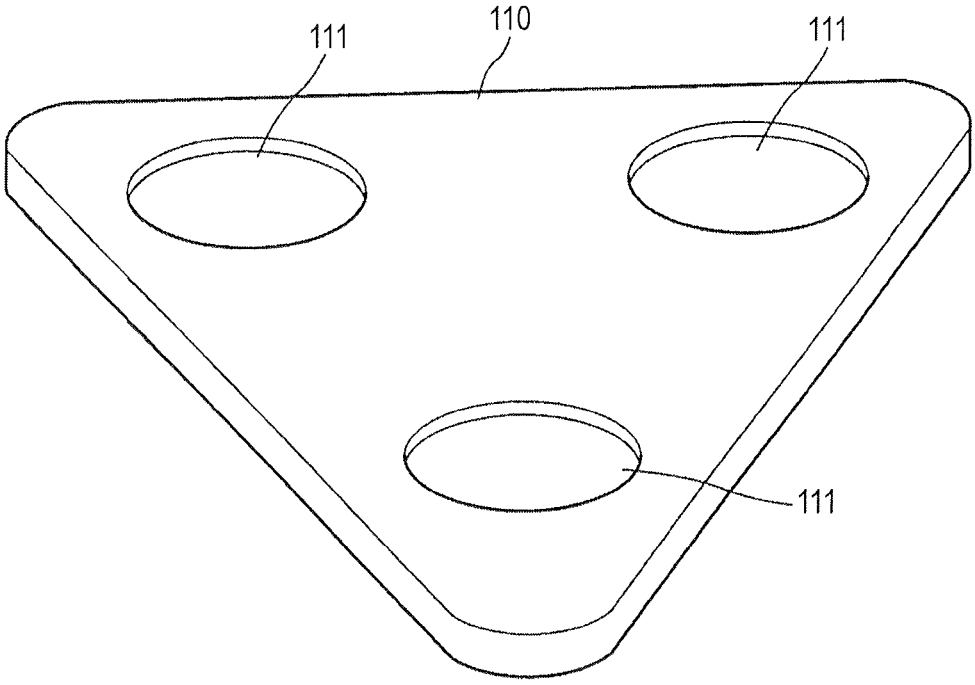
FIG. 2 is a perspective view showing a microphone base in which the microphone device is mounted.

In addition, in the case that measurement is made in the state that the microphone device 1 is mounted in the circular concave section 111 of the microphone base 110 shown in FIG. 2, it is preferable that the planar shape (the shape of the bottom face) of the microphone device is formed such that the circumscribed circle thereof has the same size as that of the circular concave section and such that the microphone unit 3 (the opening section 11) is placed at the center of the circumscribed circle so that the position of the microphone unit 3 does not change depending on the mounting direction of the microphone device 1.

FIGS. 8A to 8D are graphs in which the frequency characteristics in the case that the housing has the quadrangular planar shape shown in FIG. 7A selected from among the various shapes shown in FIGS. 7A to 7C are compared with the frequency characteristics in the case that the housing has the triangular planar shape shown in FIG. 4. Although both the apparatuses have the housings having shapes satisfying the above-mentioned conditions and both the apparatuses exhibit excellent characteristics in comparison with the conventional apparatus, it is found that the apparatus having the housing having the triangular shape, in which the number of corners is small and the distance difference (distance ratio) between the nearest point and the farthest point is large, exhibits better characteristics. It is assumed further preferable that the distance ratio between the nearest point and the farthest point is two (in the shape of the equilateral triangle).

In the embodiments shown in FIG. 4 and FIGS. 7A to 7C, the boundary between the upper face and the side face of the microphone device is formed by a single line (side (edge) 13); however, round-chamfering may be performed from the upper face to the side face, whereby a ridge line having a gently changing shape and having a certain width may be used as the boundary. Furthermore, chamfering may be performed at a plurality of corners, whereby the boundary may be formed of a plurality of belt-like portions. In these cases, the range having this round-chamfered ridge line shape or this belt-like shape, having the width, may be assumed to be the edge. Moreover, in the case of a shape in which its upper face is inclined gradually to its bottom face (having no side faces), the contour line (planar shape) of the upper face (bottom face) may be assumed to be the edge.

In the embodiments shown in FIG. 4 and FIGS. 7A to 7C, the distance (that is, the contour shape of the upper face) from each point of the side (edge) of the upper face to the opening section (the microphone unit) changes gradually and continuously; however, portions having the same distance may exist in a short range. In the case that the range having the same distance is ½ or less of the whole circumference of the edge, it is assumed that the advantage of the present invention can be obtained.

In the embodiments shown in FIG. 4 and FIGS. 7A to 7C, the shape of the upper face has been described as a shape in which the distance from the side (edge) of the upper face to the opening section (the microphone unit) changes, and the base point for the distance at the opening section has been described as the center of the opening section for convenience sake. However, in the embodiment according to the present invention, the base point for the distance at the opening section is not limited to the center of the opening section. Any point on the edge portion of the opening section may be used as the base point, or an intermediate point between any point on the edge portion and the center portion may be used as the base point. The whole of the opening section may also be used as the base point.

Although the measurement microphone device 1 for measuring the acoustic characteristics of an audio system or a listening room has been described in this embodiment, the present invention is not limited to measurement microphone devices but may be applied to recording microphones.

Although the present invention has been described in detail referring to the specific embodiment, it is obvious to those skilled in the art that various changes and modifications can be made without departing from the spirit and scope of the present invention.

This application is based on Japanese Patent Application (2012-034892) filed on Feb. 21, 2012 and Japanese Patent Application (2012-269546) filed on Dec. 10, 2012, the contents of which are hereby incorporated by reference.

DESCRIPTION OF REFERENCE NUMERALS AND SIGNS

1 microphone device
2 housing
3 microphone unit
11 opening section
13 side (edge)
110 microphone base
111 concave section

The invention claimed is:

1. A microphone device comprising: a housing having an opening section in an upper face thereof and having a polygonal planar shape; and a non-directional microphone unit incorporated in the housing and provided inside the opening section, wherein the housing includes the upper face, a side face and a bottom face, an edge is defined as a boundary between the upper face, and the side face or the bottom face, the opening section is located at a center of a circumscribed circle of a planar shape of the upper face, and the upper face of the housing has a shape in which an average value of a distance from the edge to the microphone unit throughout a whole circumference of the upper face is shorter than ½ of a wavelength of a sound wave of 10 kHz and in which a ratio of a longest distance to a shortest distance, from the edge to the microphone unit, is two or more in each side of the polygonal shape.

2. The microphone device according to claim 1, wherein the upper face of the housing has a convex shape with the opening section as an apex.

* * * * *